US012630906B2

(12) United States Patent
Espedal et al.

(10) Patent No.: US 12,630,906 B2
(45) Date of Patent: May 19, 2026

(54) HIGH CORROSION AND HEAT RESISTANT ALUMINUM ALLOY

(71) Applicant: HYDRO EXTRUDED SOLUTIONS AS, Oslo (NO)

(72) Inventors: Arvid Espedal, Mårslet (DK); Xiao-Jun Jiang, Haugesund (NO); Minxia Li, Suzhou (CN)

(73) Assignee: HYDRO EXTRUDED SOLUTIONS AS, Oslo (NO)

( * ) Notice: Subject to any disclaimer, the term of this patent is extended or adjusted under 35 U.S.C. 154(b) by 899 days.

(21) Appl. No.: 17/800,122

(22) PCT Filed: Feb. 16, 2021

(86) PCT No.: PCT/EP2021/053781
§ 371 (c)(1),
(2) Date: Aug. 16, 2022

(87) PCT Pub. No.: WO2021/165264
PCT Pub. Date: Aug. 26, 2021

(65) Prior Publication Data

US 2025/0270679 A1 Aug. 28, 2025

(30) Foreign Application Priority Data

Feb. 17, 2020 (SE) ..... 2050175-5
Feb. 21, 2020 (SE) ..... 2050197-9

(51) Int. Cl.
*C22C 21/00* (2006.01)
*C22F 1/04* (2006.01)

(52) U.S. Cl.
CPC ..... *C22C 21/00* (2013.01)

(58) Field of Classification Search
CPC ..... C22F 1/04–057
See application file for complete search history.

(56) References Cited

U.S. PATENT DOCUMENTS 4,121,926 A 10/1978 Ogawa et al.
2002/0007881 A1* 1/2002 Daaland ..... C22C 21/10 148/439
2003/0102060 A1 6/2003 Daaland et al.

FOREIGN PATENT DOCUMENTS

CN 1273614 11/2000
CN 1359427 7/2002
(Continued)

OTHER PUBLICATIONS

International Searching Authority, "International Search Report and Written Opinion" issued for corresponding International Application No. PCT/EP2021/053781, mailed on Apr. 13, 2021 (14 pages).
(Continued)

*Primary Examiner* — Lois L Zheng
(74) *Attorney, Agent, or Firm* — Wenderoth, Lind & Ponack, L.L.P.

(57) ABSTRACT

The invention relates to an aluminium based, corrosion resistant alloy consisting of
0.05-0.2% by weight of silicon,
0.01-0.3% by weight of iron,
0.20-0.6% by weight of manganese,
<0.10% by weight of magnesium,
0.15-0.5% by weight of zinc,
0.25-0.5% by weight of chromium,
0.05-0.2% by weight of titanium,
≤0.20% by weight vanadium, up to 0.05% by weight of other impurities, each not greater then 0.05% by weight and the balance aluminium.

10 Claims, 2 Drawing Sheets

(56) References Cited

FOREIGN PATENT DOCUMENTS

| | | | |
|---|---|---|---|
| CN | 1443249 | | 9/2003 |
| CN | 103397228 | | 11/2013 |
| CN | 103397228 | A | 11/2013 |
| FR | 2418275 | A1 | 9/1979 |
| WO | 01/90430 | | 11/2001 |

OTHER PUBLICATIONS

Chinese Office Action dated May 29, 2023 in Chinese Patent Application No. 202180014592.0, with English translation.

* cited by examiner

| Strength/ Elongation | Alloy B | Alloy A |
|---|---|---|
| Rm (Mpa) | 100 | 93 |
| Rp0 . 2 (Mpa) | 30 | 31 |
| A5 (%) | 46 | 54 |
| Ag (%) | 25 | 23 |

HIGH CORROSION AND HEAT RESISTANT ALUMINUM ALLOY

The invention relates to a high corrosion resistant aluminium alloy, especially an alloy intended to be used for manufacture of automotive air conditioning tubes for applications as heat exchanger tubing or refrigerant carrying tubes, or general fluid carrying tubes. The alloy has an improved resistance to pitting corrosion also at high temperature and enhanced mechanical properties especially in bending and end-forming.

The introduction of aluminium alloy materials for automotive heat exchange components is now widespread, applications including both engine cooling and air conditioning systems. In the air conditioning systems, the aluminium components include the condenser, the evaporator and the refrigerant routing lines or fluid carrying lines. In service these components may be subjected to conditions that include mechanical loading, vibration, stone impingement and road chemicals (e.g. salt water environments during winter driving conditions). Aluminium alloys of the AA3000 series type have found extensive use for these applications due to their combination of relatively high strength, light weight, corrosion resistance and extrudability. The AA3000 series alloys (like AA3102, AA3003 and AA3103), however, suffers from extensive pitting corrosion when subjected to corrosive environments, leading to failure of the automotive component, in particular at high temperatures. To be able to meet the rising targets/requirements for longer life on the automotive systems new alloys have been developed with significantly better corrosion resistance.

Especially for condenser tubing, 'long life' alloy alternatives have been developed, such as those disclosed in U.S. Pat. No. 5,286,316 and WO-A-97/46726. The alloys disclosed in these publications are alternatives to the standard AA3102 or AA1100 alloys used in condenser tubes, i.e. extruded tube material of relatively low mechanical strength. Due to the improved corrosion performance of the condenser tubing the corrosion focus have shifted towards the next area to fail, the manifold and the refrigerant carrying tube lines. Additionally, the tendency towards using more under vehicle tube runs, e.g. rear climate control systems, requires improved alloys due to the heavier exposure towards the road environment. The fluid carrying tube lines are usually fabricated by means of extrusion and final precision drawing in several steps to the final dimension, and the dominating alloys for this application are AA3003 and AA3103 with a higher strength and stiffness compared to the AA3102 alloy. The new requirements have therefore created a demand for an aluminium alloy with processing flexibility and mechanical strength similar or better than the AA3003/AA3103 alloys, but with improved corrosion resistance independent of the brazing cycle used.

EP1155157 describes a corrosion resistant aluminium alloy containing relatively high amounts of Mn, Fe and Zn apart from some quantities of Si, Cn, Mg, Cr and Ti. Examples of corrosion resistant alloys consist of: 0.05-0.15% by weight of silicon, 0.06-0.35% by weight of iron, 0.01-1.00% by weight of manganese, 0.02-0.60% by weight of magnesium, 0.05-0.70% by weight of zinc, 0-0.25% by weight of chromium, 0-0.20% by weight of zirconium, 0-0.25% by weight of titanium, 0-0.10% by weight of copper, up to 0.15% by weight of other impurities, each not greater than 0.03%. This alloy does not possess the high temperature resistance as the alloy of the present invention which in addition has improved formability, especially drawability and corrosion resistance also at high temperature.

SUMMARY OF THE INVENTION

The object of this invention is to provide an extrudable, drawable and brazeable aluminium alloy that has improved high temperature resistance and is suitable for use in thin wall, fluid carrying tube lines. It is a further object of the present invention to provide an aluminium alloy suitable for use in heat exchanger tubing or extrusions. A still further object of the present invention is to provide an aluminium alloy with improved formability during bending and end-forming operations.

The invention provides an extruded tube alloy having a mechanical strength similar to 3103/3003 type alloys, but more resistance to microstructural changes during heat treatment which would have a detrimental effect on corrosion performance due to re-location of elements which mainly will precipitate at grain boundaries and thereby promote intergranular corrosion (IGC). By substituting some of the Mn content with Cr which has a much slower diffusion rate, the as extruded product presents a more stable microstructure during sub-sequent processing. Addition of Cr is balanced to the Mn content for the target mechanical strength level. The Mn/Fe ratio should preferably be >2 to ensure a beneficial chemistry of intermetallics characteristic for a corrosion resistant alloy.

During the brazing process the smaller dispersoids of the AlMnFeSi alloy are dissolved to a greater extent than that for the AlMnFeCrSi alloy variant which will have a two-fold consequence; the dissolved elements would be relocated mainly at grain boundaries during cooling and the mechanical properties will be degraded by this type of change. Introducing Cr into the particles will stabilize the microstructure and effects of heat treatment (brazing, annealing) would be more predictable for mass production.

The invention will be further described in detail in the following by means of examples and with reference to the attached drawings, where:

FIG. 1*a* shows the effect of brazing cycle on the particle distribution for an AlMnFeSi-alloy according to the prior art, and FIG. 1*b* shows the effect of the brazing cycle on the particle distribution for an AlMnFeCrSi-alloy according to the invention.

DETAILED DESCRIPTION OF THE INVENTION

Figure 1A:
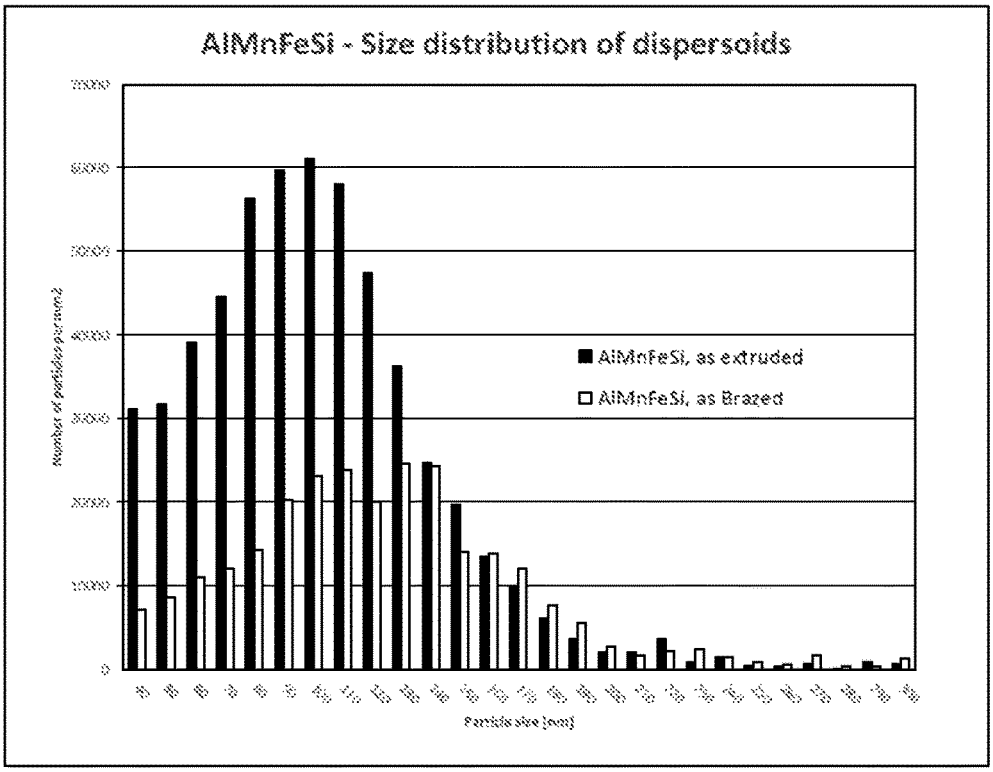

The present invention provides an aluminium-based alloy, consisting of 0.05-0.2% by weight of silicon, 0.01-0.3% by weight of iron, <0.10% by weight of magnesium, 0.2-0.6% by weight of manganese, 0.15-0.5% by weight of zinc, 0.25-0.5% by weight of chromium, 0.05-0.2% by weight of titanium, ≤0.2% by weight V, up to 0.05% by weight of other impurities, each not greater then 0.05% by weight and the balance aluminium. The Mn/Fe ratio should preferably be larger than 2, to ensure a beneficial chemistry of intermetallics for a corrosion resistant alloy.

The reason for limitation of the individual alloying elements will now be described.

The manganese content should be 0.2-0.6% by weight, preferably 0.3-0.45% by weight. The addition of manganese contributes to the strength, however, it is a major point to reduce the negative effect of manganese with respect to precipitation of manganese bearing phases during final annealing, which contributes to a coarser final grain size and increase risk for relocation of precipitates at the grain boundaries and development of IGC.

The content of magnesium should be below 0.1% by weight due to its strong effect in reduced extrudability. Additions above 0.1% by weight are also incompatible with good brazeability in inert gas brazing.

In view of the polluting effect of zinc (ex. even small zinc concentrations negatively affect the anodizing properties of AA6000 series alloy), the level of this element should be kept low to make the alloy more recyclable and save cost in the cast house. Zinc has a strong positive effect on the corrosion resistance which promote lateral corrosion if added from 0.15-0.50% by weight, but for the reasons given above the amount of zinc is preferably between 0.15-0.35% by weight, more preferably 0.20-0.30% by weight.

The iron content of the alloy according to the invention should be between 0.01-0.3% by weight. In general, a low iron content is desirable for improved corrosion resistance, as it reduces the amount of iron rich particles which generally creates sites for pitting corrosion attack. A lower content of Fe could be difficult to achieve from a cast-house standpoint of view, and also has a negative influence on the final grain size (due to less iron rich particles acting as nucleation sites for recrystallization). To counterbalance the negative effect of a relatively low iron content in the alloy other elements have to be added for grain structure refinement. The preferred iron content is 0.01-0.3, preferably 0.10-0.20% by weight, giving a combination of excellent corrosion properties, good formability, final grain size and cast-house capability.

The silicon content is between 0.05-0.2% by weight, more preferably between 0.06-0.1% by weight. It is important to keep the silicon content within these limits in order to control and optimise the size distribution of AlMnFeCr/AlMnFeCrSi-type particles (both primary and secondary particles), and thereby controlling formability and the grain size in the final product.

Chromium adds to the desired mechanical strength and corrosion resistance after heat treatment (such as brazing). Significant additions of chromium, however, decreases the extrudability due to the formation of coarse primary particles and influences negatively the tube drawability. The content should be 0.25-0.5, preferably 0.27-0.35% by weight.

Further optimizing of the corrosion resistance can be obtained by adding titanium with peritectic properties between 0.05-0.2% by weight.

Vanadium adds to the positive effect of peritectic elements such as Titanium on corrosion and may be added up to 0.2% by weight. Preferably the V content is 0.05-0.2% by weight.

The elements Ti and V strengthen the corrosion resistant performance by the peritectic properties. Ti and V are peritectic elements and as such substitutional. The combined content of Ti and V extend the total solid solubility and should preferably comply with the formula: 0.1 wt %<Ti+V<0.3 wt %.

A low content of Cu and Ni is critical for corrosion resistance, therefore the content of these elements is preferably ≤0.01% by weight. Copper also has a negative effect on extrudability, even for small additions.

The content of Zn can be up to 0.5 wt %, a higher content will reduce recyclability and therefore in conflict with environmental sustainability. A preferred content of Zn is 0.15-0.5% by weight.

Cr would to some degree substitute Mn making a more stable microstructure. The content should be 0.25-0.35% by weight by weight, preferably 0.27-0.35% by weight.

Figure 1B:
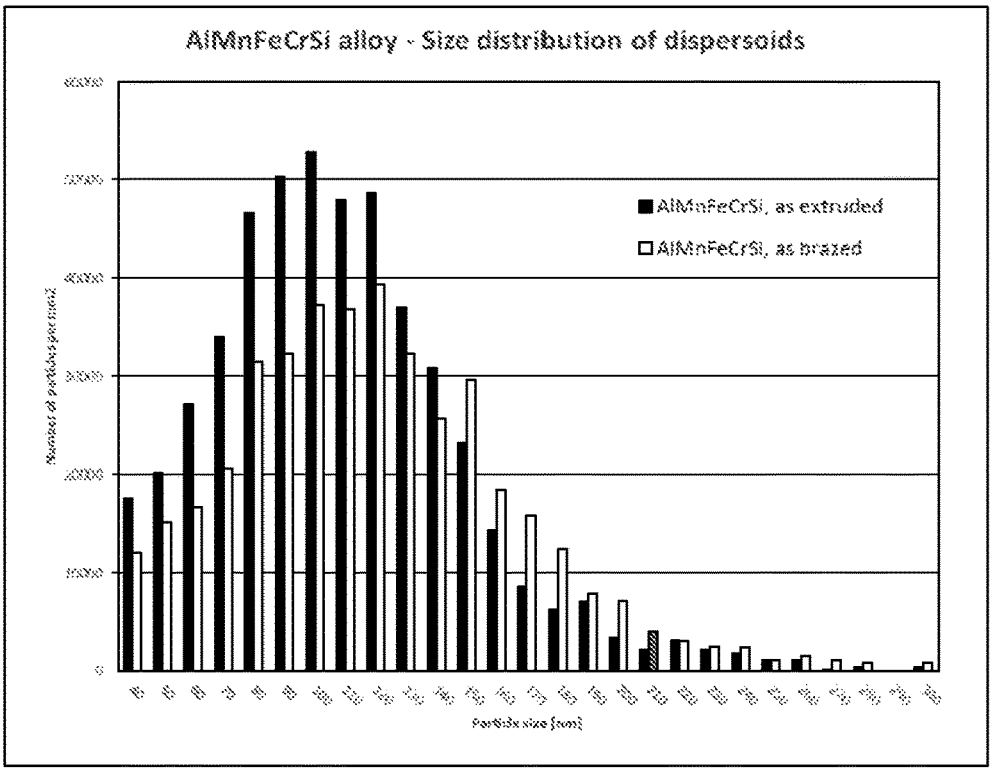

The effect of substituting Mn with Cr is demonstrated in FIG. 1, showing the size distribution of dispersoids where the change in number of precipitates before and after brazing (higher and lower bars, respectively) for the AlMnFeSi variant (Alloy AA3003) is significant compared to the change in AlMnFeCrSi variant (see Table 1) exposed to the same brazing cycle.

TABLE 1

| Alloy | Si | Fe | Cu | Mn | Mg | Cr | Zn | Ti | Ni |
|---|---|---|---|---|---|---|---|---|---|
| AlMnFeSi | 0.12 | 0.19 | <0.01 | 0.68 | 0.02 | — | — | — | <0.01 |
| AlMnFeCrSi | 0.18 | 0.17 | <0.01 | 0.60 | — | 0.13 | — | 0.13 | <0.01 |

Figures 2, 3:
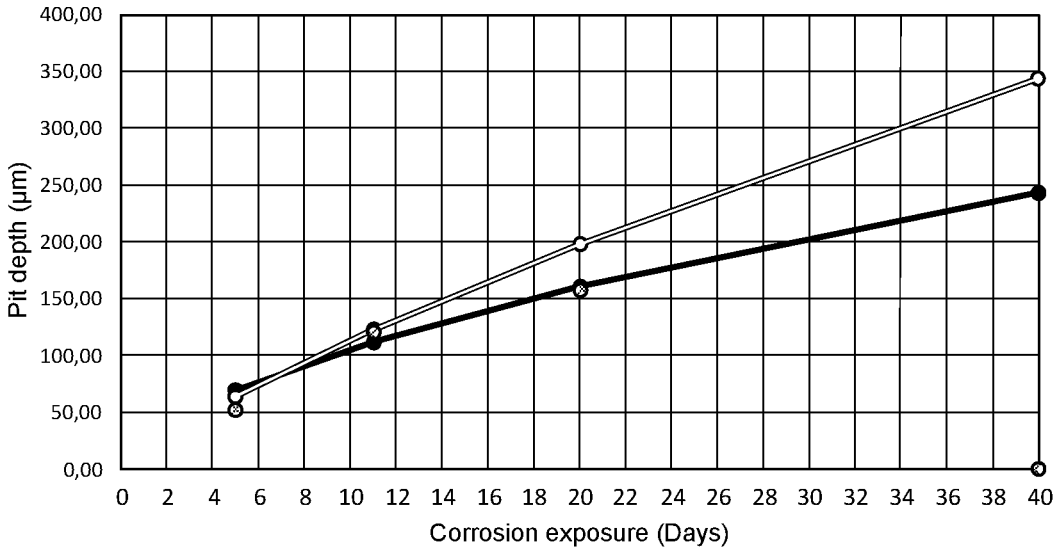
FIG. 2 shows the pit depth as a function of time for an alloy A according to the prior art (upper curve) and for the alloy B according to the invention (lower curve).
FIG. 3 shows the strength and elongation of alloy B compared to alloy A

In FIG. 2 the pit depth measured on tubes of the composition A (reference) and B (according to the invention) in Table 2 is compared. As seen in FIG. 2 the composition of alloy A according to the invention has a better corrosion resistance than the alloy B which comprises Mg but not Cr.

TABLE 2

| Alloy | Si | Fe | Cu | Mn | Mg | Cr | Zn | Ti |
|---|---|---|---|---|---|---|---|---|
| A | 0.10 | 0.13 | 0.00 | 0.44 | 0.18 | 0.06 | 0.20 | 0.13 |
| B | 0.06 | 0.17 | 0.00 | 0.35 | 0.01 | 0.29 | 0.21 | 0.11 |

In FIG. 2 the corrosion resistance of Alloy A and B (produced in O-temper) has been compared. As can be seen with a higher Cr content (alloy B is the lower curve)

In FIG. 3 the strength and elongation of alloy A and B are compared. As van be seen the strength of alloy B is slightly higher than for alloy A.

The alloys have been prepared in a traditional way by DC casting of extrusion ingots. Note that the composition of the alloys has been indicated in % by weight, taking into account that each of these alloys may contain up to 0.05% by weight of incidental impurities. Compositions were selected with varying amounts of the different major elements.

Homogenization temperature should be in the range of 550-620° C. with soak time in the range of 1-10 hours with resulting electrical conductivity in the range of 30-50% IACS.

The invention claimed is:

1. An aluminum based, corrosion resistant alloy consisting of:

0.05-0.2% by weight of silicon;

0.01-0.3% by weight of iron;
0.20-0.6% by weight of manganese;
less than 0.10% by weight of magnesium;
0.15-0.5% by weight of zinc;
0.25-0.5% by weight of chromium;
0.05-0.2% by weight of titanium;
less than or equal to 0.20% by weight vanadium; and
up to 0.05% by weight of other impurities, each not greater than 0.05% by weight and the balance aluminum.

2. The aluminum based alloy according to claim 1, wherein the alloy includes 0.3-0.45% by weight of manganese.

3. The aluminum based alloy according to claim 1, wherein the alloy includes 0.15-0.35% by weight of zinc.

4. The aluminum based alloy according to claim 1, wherein the alloy includes 0.06-0.1% by weight of silicon.

5. The aluminum based alloy according to claim 1, wherein the alloy includes 0.1-0.2% by weight or iron.

6. The aluminum based alloy according to claim 1, wherein the alloy includes 0.27-0.35% by weight of chromium.

7. The aluminum based alloy according to claim 1, wherein the alloy includes 0.05-0.2% by weight vanadium.

8. The aluminum based alloy according to claim 1, wherein a ratio of the % by weight of manganese and the % by weight of iron is greater than 2.

9. The aluminum based alloy according to claim 1, wherein 0.1 wt %<Ti+V<0.3 wt %.

10. The aluminum based alloy according to claim 1, wherein the alloy includes 0.2-0.3% by weight of zinc.

* * * * *